United States Patent [19]

Willim

[11] 3,981,347

[45] Sept. 21, 1976

[54] METHOD AND APPARATUS FOR STRAND COOLING WITH A FLAT SPRAY PATTERN

[75] Inventor: Fritz Willim, Birmensdorf, Switzerland

[73] Assignee: Concast AG, Zurich, Switzerland

[22] Filed: Apr. 21, 1975

[21] Appl. No.: 570,220

[30] Foreign Application Priority Data

Apr. 26, 1974 Switzerland ..... 5748/74

[52] U.S. Cl. ..... 164/89; 118/315; 134/122 R; 164/283 S; 239/543

[51] Int. Cl.[2] ..... B22D 11/124

[58] Field of Search ..... 164/89, 283 R, 283 S; 134/64 R, 122 R; 239/536, 543; 118/315

[56] References Cited

UNITED STATES PATENTS

| | | | |
|---|---|---|---|
| 3,693,352 | 9/1972 | Hinze et al. | 164/89 X |
| 3,753,793 | 8/1973 | Wagener et al. | 164/89 X |
| 3,877,510 | 4/1975 | Tegtmeier et al. | 164/283 S |

*Primary Examiner*—Robert D. Baldwin
*Attorney, Agent, or Firm*—Werner W. Kleeman

[57] ABSTRACT

A method of, and apparatus for, the cooling of a strand during the continuous casting of metals, especially steel, wherein a cooling fluid possessing a regulatable quantity for impingement at the surface of the strand is sprayed between two guide elements neighboring one another in the direction of strand travel onto the strand surface. According to the invention, the cooling liquid or fluid is selectively sprayed from one spray pattern or two spray patterns which are essentially similarly directed and initially extend behind one another in the direction of travel of the strand and thereafter are united into a spray pattern having a flat spray characteristic, wherein the united spray pattern has a thickness and direction which approximately corresponds to that of one of the adjacently situated spray patterns.

12 Claims, 2 Drawing Figures

METHOD AND APPARATUS FOR STRAND COOLING WITH A FLAT SPRAY PATTERN

BACKGROUND OF THE INVENTION

The present invention relates to a new and improved method of, and apparatus for, cooling a strand during the continuous casting of metals, especially steel, wherein a cooling fluid or coolant having a regulatable quantity for impinging the strand surface is sprayed between two guide elements neighboring one another in the direction of travel of the strand onto the strand surface.

It is already known in this particular field of technology to turn-on and turn-off the nozzles of individual nozzle blocks in order to accommodate the cooling conditions for the strand to the casting parameters, such as for instance casting speed. With this technique there is indeed realized a certain regulation possibility, but there must however be accepted irregularities as concerns the impingement of the strand surface with the cooling fluid or agent and the cooling over the strand width. When turning-off the cooling fluid, typically cooling water, of a row of nozzles extending transverse to the strand axis the spacing between the upper and lower nozzle rows neighboring the turned-off nozzle row in the direction of travel of the strand and the corresponding impingement surfaces at the strand, respectively, becomes so large that there can occur fissures or cracks in the cast product or casting. There is likewise not contemplated a reduction in the supporting distance of the guide elements.

It is further known to the art for the purpose of producing cooling agent spray patterns or fans to have at least two flat spray patterns intersect one another at a location spaced from the surface of the strand, wherein at least one of the flat spray patterns deviates in its direction from the perpendicular impinging at the strand surface. The distribution of the quantity of cooling agent is such that from the center of the strand towards the edges thereof lesser quantities of water are sprayed onto the strand surface. With this proposal the relevant flat spray nozzles are adjusted at an angle with respect to one another, so that there is realized an overlapping of the spray patterns. In this way there is realized an increased width of the impinged surface. Yet, due to the overlapping or intersection of the spray patterns or jets it is well known in this art that there arises a mutual disturbance or interference of the spray patterns as well as in consequence thereof irregular cooling. Furthermore, both the kinetic energy of the cooling agent particles and the cooling action are reduced.

There is also known to the art a flat spray pattern nozzle for producing two narrow spray patterns. However, this nozzle is arranged such that the two spray patterns impinge at the edge region at neighboring strand sides without mutual contact.

SUMMARY OF THE INVENTION

It is a primary object of the present invention to provide an improved method of, and apparatus for, the cooling of a continuously cast strand in a manner not associated with the aforementioned drawbacks or limitations of the prior art proposals.

Another and more specific object of the present invention aims at the provision of a novel method and apparatus which enables spraying as large as possible quantity of cooling agent, which can be regulated over a wide range, between guide elements onto the strand surface in order to thereby realize an accommodation of the impinging quantity of cooling agent to different casting parameters, such as for instance casting speed and quality of the steel, and to thereby obtain an improved quality of the surface of the cast product.

Still a further objective of the invention is to make it possible to hold the mutual spacing of neighboring guide elements for the strand to a minimum and thus also the mutual spacing of the impingement surfaces at the strand which follow in the direction of strand travel.

Now in order to implement these and still further objects of the invention, which will become more readily apparent as the description proceeds, the method aspects of this development contemplate selectively spraying cooling liquid from one spray pattern or from two spray patterns essentially directed in the same direction which initially extend adjacent one another in the direction of travel of the strand, thereafter combine or unite into a flat spray pattern, the thickness and direction of which approximately corresponds to that of one of the adjacently disposed spray patterns.

As previously mentioned the invention is not only concerned with the aforediscussed method aspects, but also deals with apparatus for the performance thereof, and which apparatus comprises two flat spray pattern nozzles arranged in spaced relationship from one another and having nozzle outlet openings for spray patterns essentially unidirected and extending initially behind one another i.e. in tandem with respect to the direction of travel of the strand. These flat spray pattern nozzles are also spaced from the strand surface in order to form the flat spray pattern or fan. The mutual spacing of the spray nozzles from one another amounts to between approximately 5 and 50 millimeters.

The flat spray pattern i.e. a spray pattern having a flat characteristic, is formed in front of the impingement surface at the strand, that is to say, before such spray pattern impacts against the strand surface. If the cooling should occur through the action of the cooling agent of two spray patterns then the latter, prior to their being united or combined into a total or combined spray pattern, extend essentially unidirectionally, that is to say, in such a way that their central planes are disposed approximately perpendicular to the strand surface. Due to the foregoing there is achieved the beneficial result that there does not occur any too great angular impingement or impacting of individual spray particles, as such for instance is the case when there is present a crossing or intersection of spray films. This is associated with the advantage that the individual cooling agent droplets are not deflected outwardly out of their path of travel when the spray pattern meet one another and the kinetic energy of such particles is not reduced. Furthermore, there is possible by virtue of the foregoing the formation of a flat spray pattern having a relatively sharply defined envelope surface or outer boundary, enhancing the uniformity of the cooling action.

The flat spray pattern can be formed from the composite or sum of the cooling agent quantities of two partial spray jets i.e. spray patterns, wherein the thickness and direction thereof after the uniting of the two partial spray patterns approximately correspond to that of one of the adjacently situated spray patterns. In this way there is formed a very narrow flat spray pattern. Moreover, the quantity of cooling agent of each individual spray pattern is adjusted by conventional means as is known in this field of technology. Due to the selective or optional spraying with cooling agent from one or two spray patterns uniting into a flat spray pattern, it is possible to regulate over a wide range the total quantity of impinging cooling agent which impacts at the strand surface and to accommodate such to the momentary requirements prevailing at the continuous casting plant which, for instance, are governed by composition of the steel, casting speed, temperature of the steel and so forth.

By selecting the distance between the spray patterns and by adjusting the pressure of the cooling agent in front of the outlet openings so as to exceed 1.5 atmospheres excess pressure the spray patterns which initially travel alongside one another in adjacent relationship, prior to impingement of the cooling agent at the strand surface are combined into a flat spray pattern i.e. a spray pattern having a flat spray characteristic by a suction-like effect. Due to this surprising effect there is produced a relatively narrow flat spray pattern, wherein again it is possible to maintain small the spacing of the guide elements neighboring one another in the direction of travel of the strand.

Now if the strand is guided by guide elements in the form of guide rollers then the flat pattern is formed as concerns its thickness in such a manner that the same, upon passage between the rollers, approximately corresponds to the smallest mutual spacing of such neighboring guide rollers. Stated in another way, the envelope surface of the flat spray pattern just touches the rollers. Consequently, the gap i.e. the smallest intermediate space between the guide elements is filled-out by the flat spray pattern. Due to this measure of commingling or uniting the partial spray jets i.e. the spray patterns, it is possible to maintain the roller spacing very small, so that there can again be realized a higher casting speed without any danger of bulging-out or dishing of the strand. Owing to the possibility of bringing the guide rollers closer together by virtue of the teachings of the invention there is also reduced the spacing of the impingement surfaces at the strand which follow one another in the direction of strand travel. Owing to this shortened sequence of impingement surfaces cooling of the strand becomes more uniform and there is a reduction in the danger of fissure formations.

The cooling liquid for forming the spray patterns of the partial spray jets or patterns can be deflected approximately at right-angles to the original flow direction in the infeed opening of the relevant nozzle. In this way there is realized an outstanding spraying of the cooling agent or medium.

It can be advantageous to form a flat spray pattern from spray patterns having essentially uniform distribution of the quantities of cooling agent or fluid over their width. As a result the formed flat spray pattern also possesses a uniform impingement quantity of coolant transversely with respect to the lengthwise axis of the strand.

According to a further advantageous feature of the invention, due to an appropriate superimposing of the spray patterns there is produced at the strand an impinging surface which essentially corresponds to the impingement surface of one spray pattern. Consequently, the specific impingement quantity can be markedly changed at a surface having relatively lesser thickness and thus it is also possible to vary the cooling intensity.

In order to provide a saving in the number of required nozzles and for realizing an uninterrupted impingement surface transverse to the strand the width of the flat spray pattern can be made to correspond to that of the strand width. This is brought about by selecting a suitable spray angle of the nozzles and/or by adjusting the required spacing of the nozzles with respect to the strand surface. In this regard it is advantageous to cool the strand over its width along the impingement surface transverse to the direction of travel of the strand with approximately uniform distribution of the quantity of cooling agent and uniform impingement pressure.

The apparatus of this development possesses two flat spray pattern nozzles which possess outlet openings for spray patterns which are essentially unidirectional and which spray patterns initially extend adjacent to one another. The spacing of the outlet openings from one another is in the order of between 5 and 50 millimeters. The lower limit of 5 millimeters is given by the possibility of moving the nozzles close to one another, the upper limit of 50 millimeters by the requirement of having an appropriate uniting of the spray patterns. By virtue of the small spacing there is also realized the result that the effluxing or outflowing partial jets, already after moving through a relatively short distance merge with one another without practically any energy loss by the aforementioned suction-like effect and form the flat spray pattern.

The mutual spacing of the nozzles from one another is adjusted within this aforementioned range in such a manner that the spray patterns, the medial or central planes of which are located essentially perpendicular to the strand surface, unite with one another after a certain distance and form a combined or total spray pattern or jet. During the formation thereof the outlet openings of the nozzles are also arranged at an appropriate spacing from the strand surface.

According to a constructional manifestation of the invention the nozzle outlet openings extend in the form of slots transversely with respect to the lengthwise axis of the nozzle body and the introduced cooling agent or coolant is deflected within the nozzle at approximately right-angles. In this way there is realized a good spraying of the cooling agent.

For the exact adjustment of the spray pattern it is possible to alter the spacing of at least one nozzle outlet opening with respect to the strand surface.

In order to bring the partial spray patterns or jets as close to one another as possible, it is a capability of the invention to dissimilarly adjust the spacing of the outlet openings of the nozzles with respect to the impinged strand surface.

BRIEF DESCRIPTION OF THE DRAWING

The invention will be better understood and objects other than those set forth above, will become apparent when consideration is given to the following detailed description thereof. Such description makes reference to the annexed drawing showing two exemplary embodiments of the invention for carrying out the method and specifically wherein.

DETAILED DESCRIPTION OF THE INVENTION

Figure 1:
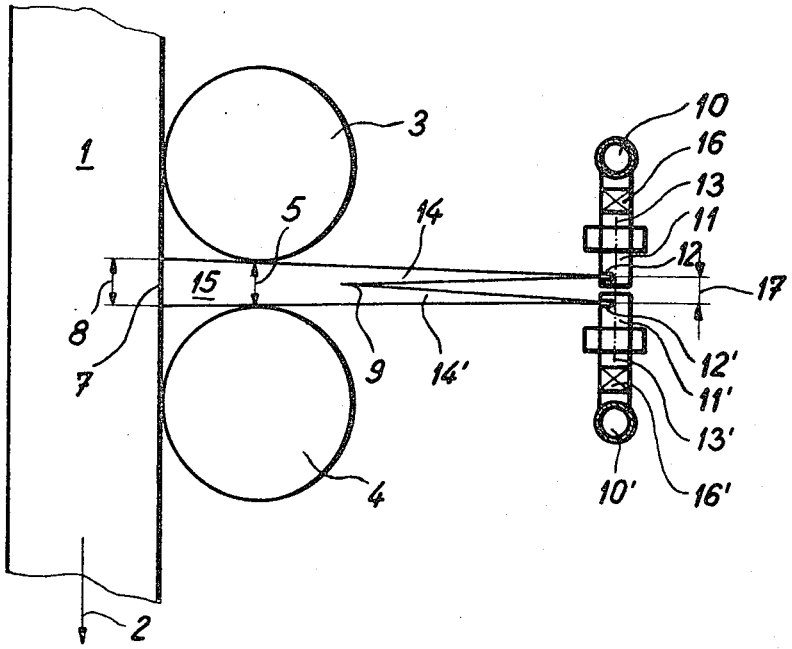
FIG. 1 is a front view of a continuously cast strand, part of the guide rollers, the flat spray pattern and the arrangement of the nozzles all being schematically shown.

Describing now the drawing, it is to be understood that only enough of the structure of the continuous casting plant has been shown to enable those skilled in the art to readily understand the underlying concepts of this development. Turning attention to FIG. 1 in particular, there is shown a continuously cast steel strand 1 of for instance square cross-section, the cast strand moving in the direction of travel 2 and being supported and guided by guide elements here shown in the form of guide rollers 3 and 4. It is to be understood however that the invention is not limited to an arrangement using guide rollers as the guide elements, since other types of guide elements can be employed, such as for instance also grid-like guide elements, so-called cooling grids.

Equally it is to be appreciated that for simplifying the showing of the drawing and the explanation of the invention the strand cooling apparatus and the guide elements have only been illustrated at one side of the cast strand but a similar arrangement would be present at the opposite side as those versed in the art would clearly appreciate and as is common practice in this technology. To simplify the disclosure the explanations to follow will be made with respect to the cooling of one side of the strand and the components at that side responsible therefor, with the understanding that, as mentioned above, similar considerations are applicable for the other side of the strand. The neighboring guide rollers 3, 4 possess a small mutual spacing 5 from one another. To prevent bowing-out of the strand this spacing 5 should be maintained as small as possible. At the region between the contact lines of the rollers 3 and 4 with the strand 1 and strand surface 7 is impinged by a flat spray pattern 15. The impingement surface 7, considered in the direction of strand travel 2, possesses a thickness designated by reference character 8. The formation of the flat spray pattern or spray jet occurs in the following way:

By means of infeed conduits or pipes 10, 10′ a suitable cooling fluid or liquid, for instance water, is delivered to the flat spray pattern nozzles 11, 11′ respectively. These flat spray pattern nozzles 11, 11′ —sometimes simply conveniently referred to hereinafter as flat spray nozzles— possess slot-like outlet or discharge openings 12, 12′ which are adjusted so as to extend transversely with respect to the strand direction of travel 2. The infed water, after being deflected out of the original flow direction of the infeed openings 18, 18′ (FIG. 2) and which is in the direction of the lengthwise axis of the nozzles, through an angle of about 90° with respect thereto, flows out through the nozzle outlet openings and in each case produces a spray pattern or partial spray jet 14, 14′ respectively. The partial jets or spray patterns 14, 14′, which are essentially unidirectional in flow and whose medial or central planes intersect approximately at right-angles or perpendicularly the strand surface which is to be impinged with the coolant, initially travel in spaced tandem relationship i.e. the spray patterns initially are spaced behind one another with respect to the strand direction of travel. After the effluxing spray patterns have moved through a certain displacement path considered with regard to the nozzle outlet openings 12, 12′ the spray patterns 14, 14′ are united into a common flat spray pattern 15 approximately at the region 9, The thickness of the flat spray pattern is chosen such that during its passage through and between the rollers it corresponds to the smallest adjusted mutual roller spacing 5. Although in no way to be considered limiting of the invention spray nozzles suitable, by way of example, for use in the practice of this invention have been disclosed in detail in U.S. application Ser. No. 324,541, filed Jan. 16, 1973, now U.S. Pat. No. 3,877,510, granted Apr. 15, 1975, and the disclosure of which is incorporated herein by reference.

The regulation of the quantity of cooling water can occur with the aid of conventional regulation devices, for instance, by means of the valves 16, 16′, whereby the total sprayed quantity of water can be varied over a wide range. Thus, for instance, by closing one of the valves such as the valve 16′, the total quantity of water of the flat spray pattern 15 now only corresponds to the quantity of water of the spray pattern 14 and which water quantity corresponds to the setting of the valve 16, that is to say, the sum of the cooling agent quantity of both spray patterns 14, 14′ corresponds to the water quantity of the partial jet or spray pattern 14. The spacing of the slot-like nozzle outlet openings 12, 12′ from one another in the direction of strand travel for the embodiment under discussion amounts to 20 millimeters. The spacing of the nozzle outlet openings 12, 12′ from the strand surface amounts to 400 millimeters. With a water quantity of 10 to 20 liters per minute and nozzles operating at water pressures of 1.5 to 6.0 atmospheres gauge both of the partial spray patterns or jets combine, due to the suction action, approximately at a spacing of 130 millimeters from their outlet locations. The thickness of the thus formed approximately parallel flat spray pattern corresponds to the smallest spacing of the guide rollers 3 and 4 from one another and amounts to about 45 millimeters.

Figure 2:
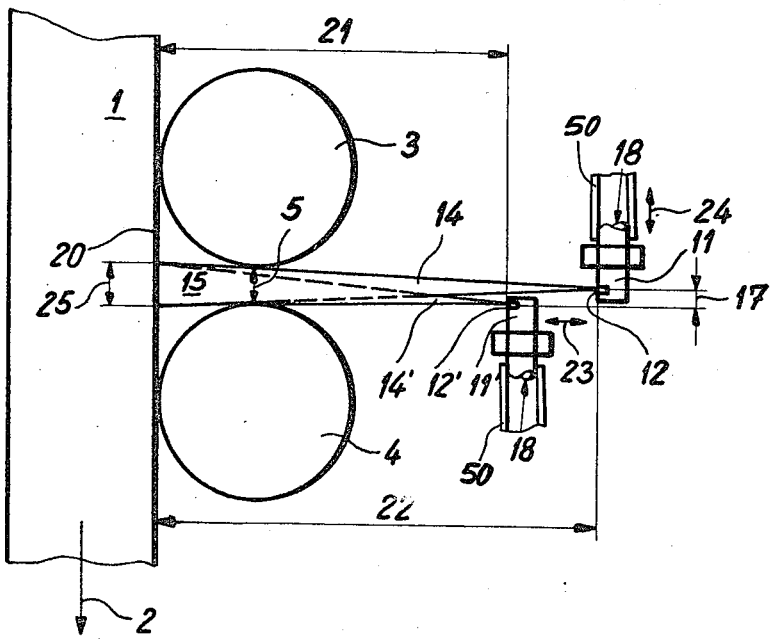
FIG. 2 is an illustration essentially corresponding to the showing of FIG. 1 of a variant embodiment of the invention.

In FIG. 2 there is illustrated an exemplary embodiment of the invention wherein the outlet openings 12, 12′ of two nozzles 11 and 11′, respectively, which directly follow one another in the direction of travel 2 of the strand 1, possess different spacings 21, 22 from the strand surface. This also provides the advantage that the mutual spacing 17 of the outlet openings 12, 12′ of the nozzles 11, 11′ can be still further reduced, whereby also due to the further bringing closer together of the spray patterns 14, 14′ there is possible a reduction of the smallest spacing 5 of the rollers 3, 4 from one another. Due to the reduction of the supporting spacing of the guide rollers there is rendered more difficult the realization of the conditions needed for the strand to bow-out. For the exact adjustment of the spray patterns at least one of the nozzles 11, 11′ can be adjustable in its position relative to the strand surface, as indicated by the double-headed arrow 23. In the same vein, also at least one of the nozzles 11, 11′ can be changed in position in the lengthwise direction of the strand in order to render possible an exact adjustment of the spacing 17 between the nozzles, and as the same has been schematically indicated by reference character 24 associated with the double-headed arrow thusly labeled. The means for carrying out the above described adjustments in the directions of the respective double-headed arrows 23, 24 are conventional and schematically indicated by the adjustment means 50 shown in FIG. 2, it being understood that comparable adjustment means can be used in the arrangement of FIG. 1. Such adjustment means are well known to the art, as exemplified for instance by the teachings of the commonly assigned U.S. Pat. No. 3,468,362, granted Sept. 23, 1969 to which reference may be readily had and the disclosure of which is incorporated herein by reference. Upon impinging the strand with a total flat spray pattern over the width of the strand there thus can occur an accommodation of the length of the impingement surface to different strand shapes or formats or widths respectively. The effluxing quantities of cooling agent, as already shown in FIG. 1, are adjustable by standard quantity regulation devices, typically for instance the previously mentioned valves 16, 16'. According to the embodiment of FIG. 2 the flat spray pattern 15 is formed in such a manner that its impingement surface having the thickness 25 essentially corresponds to the impingement surface of a partial spray pattern or jet 14, 14'. This is also schematically shown by the broken line illustrated ideal boundary surfaces of the spray patterns 14, 14' following their uniting into the total flat spray pattern. Upon reduction of the water quantity to null, for instance sprayed by the nozzle 14', the spray pattern 14 now only then impinges the strand surface and specifically within an essentially unchanged impingement surface having the thickness 25.

It is also possible to combine two spray patterns having different spray angles, so that the strand impinged by the total spray pattern can be cooled more intensively at its center. It is likewise possible to combine two spray patterns having different spray characteristics in order to obtain a desired distribution of the water quantity in the total flat spray pattern and over the impinged strand surface respectively.

While there is shown and described present preferred embodiments of the invention, it is to be distinctly understood that the invention is not limited thereto, but may be otherwise variously embodied and practiced within the scope of the following claims.

Accordingly, what is claimed is:

1. A method of cooling a strand during the continuous casting of metals, especially steel, comprising the steps of guiding the cast strand between neighboring spaced strand guide elements extending in the direction of travel of the strand, selectively spraying cooling fluid between two neighboring strand guide elements from two spray patterns which are essentially unidirectional onto the surface of the strand, said two spray patterns initially extending behind one another in the direction of travel of the strand and thereafter being united into a flat spray pattern, the thickness and direction of which approximately corresponds to that of one of the adjacently situated spray patterns.

2. The method as defined in claim 1, including the step of employing spray nozzles having nozzle outlet openings for forming the spray patterns, and selecting the distance between the spray patterns and adjusting the pressure of the cooling fluid to exceed 1.5 atmospheres excess pressure in front of the nozzle outlet openings in order that the initially adjacently situated spray patterns, prior to impingement of the cooling fluid at the surface of the strand, are united by a suction-like effect into the flat spray pattern.

3. The method as defined in claim 1, wherein the cast strand is guided between neighboring spaced strand guide elements constituted by guide rollers, and wherein the thickness of the flat spray pattern upon passage between neighboring guide rollers corresponds approximately to the smallest mutual spacing of such neighboring guide rollers from one another.

4. The method as defined in claim 2, including the step of using spray nozzles having cooling fluid inlet openings, and wherein the cooling fluid is deflected approximately at right-angles to the original flow direction through the inlet openings of the spray nozzles in order to form the spray patterns.

5. The method as defined in claim 1, wherein the flat spary pattern is formed from spray patterns having essentially uniform distribution of the quantity of cooling fluid over the width of the corresponding spray pattern.

6. The method as defined in claim 1, including the step of producing an impingement surface of the flat spray pattern at the strand which essentially corresponds to the impingement surface of one spray pattern.

7. The method as defined in claim 1, wherein the width of the flat spray pattern is maintained to correspond to the width of the strand and the strand is cooled along its impingement surface by means of an approximately uniform quantity of cooling fluid and uniform impingement pressure of the cooling fluid.

8. The method as defined in claim 1, including the step of subsequently spraying cooling fluid only from one of said two spray patterns.

9. An apparatus for cooling a strand during the continuous casting of metals, especially steel, comprising neighboring strand guide elements arranged in spaced relationship from one another in the direction of travel of the cast strand, two flat spray pattern nozzles positioned to operate at the spacing between at least two neighboring spaced strand guide elements, means for separately regulating the inflow of a cooling agent to each of the flat spray pattern nozzles, and wherein each of the flat spray pattern nozzles are provided with a nozzle outlet opening, said two flat spray pattern nozzles with their outlet openings initially forming spray patterns which are essentially unidirectional and extending adjacent one another with respect to the direction of travel of the strand and thereafter there being formed from said spray patterns a flat spray pattern, said two flat spray nozzles being arranged at a spacing from one another and from the strand surface in order to form the flat spray pattern, and wherein the spacing of the flat spray nozzles from one another is in the order of about 5 to 50 millimeters.

10. The apparatus as defined in claim 9, wherein the nozzle outlet openings of the flat spray pattern nozzles are constituted by respective slots extending essentially transversely with respect to the lengthwise axis of the associated flat spray pattern nozzle, each of said flat spray pattern nozzles having a cooling agent inlet opening, the direction of flow of the cooling agent through the inlet opening of each flat spray pattern nozzle and through the inlet opening of each flat spray pattern nozzle being approximately disposed at right-angles to one another.

11. The apparatus as defined in claim 9, further including means for changing the spacing of the outlet opening of at least one of the flat spray pattern nozzles with respect to the surface of the strand to be impinged by the cooling agent.

12. The apparatus as defined in claim 9, further including means for altering the spacing of the outlet opening of at least one of the flat spray pattern nozzles from the surface of the strand to be impinged by the cooling agent, so that the spacing of the outlet openings of the flat spray pattern nozzles which directly follow one another in the direction of travel of the strand from the impingement surface of the strand are not equal to one another.

* * * * *